US005374072A

United States Patent [19]

Landers

[11] Patent Number: 5,374,072

[45] Date of Patent: Dec. 20, 1994

[54] ROLLER ADJUSTMENT SYSTEM FOR IN-LINE SKATES

[76] Inventor: Gary Landers, 94 Main St., Winthrop, Mass. 02152

[21] Appl. No.: 138,926

[22] Filed: Oct. 18, 1993

Related U.S. Application Data

[63] Continuation-in-part of Ser. No. 806,305, Dec. 13, 1991, Pat. No. 5,253,884.

[51] Int. Cl.[5] ..... A63C 17/06

[52] U.S. Cl. ..... 280/11.27; 280/11.22; 280/43.17; 301/1; 301/111

[58] Field of Search ..... 280/7.13, 841, 11.19, 280/11.22, 11.23, 11.27, 43, 43.17; 301/1, 111, 128

[56] References Cited

U.S. PATENT DOCUMENTS

| | | | |
|---|---|---|---|
| 576,106 | 2/1897 | Frankenberg et al. | 280/11.22 X |
| 1,068,829 | 7/1913 | Szymanski | 280/7.13 |
| 1,534,601 | 4/1925 | Matveyeff | 280/11.23 |
| 1,790,423 | 1/1931 | Hooks | 280/11.27 X |
| 1,880,915 | 10/1932 | Dyer | 280/43 X |
| 2,145,219 | 1/1939 | Burton | 280/43 X |
| 2,558,311 | 6/1951 | Morrow | 280/43 X |
| 3,649,828 | 3/1972 | Price | 280/43.17 |
| 3,884,485 | 5/1975 | Walle | 280/841 |
| 4,909,523 | 3/1990 | Olson | 280/11.22 X |
| 5,046,746 | 9/1991 | Gierveld | 280/11.22 |
| 5,068,956 | 12/1991 | Malewicz | 280/11.27 X |
| 5,092,614 | 3/1992 | Malewicz | 280/11.27 X |
| 5,253,884 | 10/1993 | Landers | 280/11.22 X |

FOREIGN PATENT DOCUMENTS

| | | | |
|---|---|---|---|
| 0277009 | 7/1914 | Germany | 280/11.27 |
| 67893 | 4/1951 | Netherlands | 280/7.13 |

*Primary Examiner*—Brian L. Johnson
*Attorney, Agent, or Firm*—Testa, Hurwitz & Thibeault

[57] ABSTRACT

An in-line skate has a boot, a chassis supporting the boot, and a plurality of wheels rotatably mounted on axles supported by the chassis. An improvement of the in-line skate is a system for adjusting the height of at least one of the axles in relation to the chassis. The system includes a pair of opposed, coaxially rotatable bushings supported by the chassis. Each of the bushings defines a through-hole for passing a wheel axle. The axle-receiving through-holes are located eccentrically to the rotational axis of the bushings. The system also includes a pair of hubs where each of the hubs is interfitted with a different one of the rotatable bushings so that rotation of the hubs is transferred to equivalent rotation of the bushings. Like the bushings, each of the hubs defines a through-hole for passing the wheel axle. The hub through-holes are located eccentrically to the rotational axis of the hubs and the interfitted bushings. The system also includes a securing device coupled to the wheel axle for securing the bushings, hubs, and axle relative to the chassis. Also included is an actuator coupled to a first one of the hubs for receiving a force to rotate the first one of the hubs and the bushing interfitted therewith. A transferring device transfers rotation of the first one of the hubs and the bushing interfitted therewith (i) to rotation of the axle and (ii) to rotation of the other hub and the other bushing interfitted therewith. The system also includes a locking device, formed with the chassis, for releasably and replaceably cooperating with a portion of the actuator to secure the hubs and the bushings interfitted therewith against unwanted rotation.

8 Claims, 7 Drawing Sheets

ROLLER ADJUSTMENT SYSTEM FOR IN-LINE SKATES

STATEMENT OF RELATED APPLICATIONS

This is a continuation-in-part application of U.S. patent application Ser. No. 07/806,305, filed Dec. 13, 1991 now U.S. Pat. No. 5,253,884.

BACKGROUND OF THE INVENTION

The invention relates generally to a system for adjusting the height of one or more axles relative to the frame or chassis of an in-line skate. In particular, the invention concerns such a system wherein the axle can be adjusted through the simple operation of a single lever, dial, or the like.

At the present time, recreational in line skates are available which in many embodiments have a boot section adapted to fit over the foot of a user and rollers attached to the boot section. The roller may be attached to the boot via a chassis either coupled to or molded as an integral part of the boot. Some skates include only a chassis for removably and replaceably receiving a boot or other type of shoe which the user can wear separate from the skate chassis.

As the name suggests, the rollers, or wheels, of in-line skates are aligned in one row rather than two rows as has been the roller arrangement for more traditionally constructed roller skates. Such in-line alignment of the wheels enables a user to achieve speeds in excess of about 30 miles per hour on a flat surface. This is significantly faster than the speeds which can be achieved through the use of conventional roller skates.

It appears that maximum speeds can be achieved using in-line skates when the user's weight is substantially evenly distributed over all of the wheels contacting the ground. In an alternative mode of use, however, some in-line skates allow one or more internal rollers to be lowered by adjusting the height of the roller axles relative to the skate chassis. When the rollers are in this position, the skater is able to execute sharp turns to quickly change the direction of his movement.

At the present time a height adjustment mechanism is provided for roller axles for in line skates which is secured to a bracket for the roller axles, which, in turn, is secured to the boot section of the in line skate. The mechanism comprises a fixed bushing having a non-circular shape which fits into a mating hole extending through the bracket. The fixed bushing has an elliptical boss which is inserted through the bracket. The fixed bushing has a hole extending through it which accommodates an axle for the roller. The fixed bushing can be removed by hand from the bracket, rotated to a second position and reinserted into the bracket hole in order to fix it within the bracket in this second position. When in the second position, the axle hole through the bushing is positioned at a height different from the height of the axle in its original position. By operating in this manner, it is possible to adjust the height of the roller axles and the roller.

A shortcoming of this axle height adjustment system, however, is that it requires the skater to remove the wheel and axle from the skate in order to reposition the stationery bushing. This procedure is time consuming and requires the use of special tools. In addition, the separated parts are small and can be easily lost.

Accordingly, it is an object of the invention to provide a system for adjusting the height of roller axles for in line skates which can be practiced quickly by hand without the need for disassembling the skate and without the need for special tools.

SUMMARY OF THE INVENTION

This and other objects are achieved in accordance with the present invention which features a system for adjusting the height of an axle for a roller relative to the chassis of an in line skate. The system enables a user of the skate to quickly and simply adjust the axle height without using special tools or needing to disassemble the skate. Indeed, in some embodiments of the invention, the user need only operate a single lever, dial, or similar device to adjust the axle height.

In one embodiment of the invention, the system comprises a pair of opposed, bushings supported by the chassis. The bushings are retained in circular holes in the chassis to permit rotation of the bushings about an axis. Each of the bushings defines a through hole for passing opposite ends of a wheel axle. The bushings define the through holes to be off center from the bushings' rotational axis. Various types of single and multiple piece axles may be used in accordance with the invention and will be readily apparent to those skilled in the art.

Each of the bushings interfits with a corresponding hub so that rotation of each hub translates to equivalent rotation of the corresponding bushing. The system further includes a mechanism such as a dial, knob, or lever, hereinafter "an actuator" which is coupled to, or formed with, at least one of the hubs. The actuator enables a user to rotate the bushing within the circular hole in the chassis. Consequently, the user can adjust the height of the wheel axle relative to the chassis by rotating the bushing. Further, a locking system is provided so that the bushing may be secured against unwanted rotation, thereby adjustably fixing the height of the axle.

In embodiments of the invention wherein only one of the hubs includes an actuator, structure is provided to transfer rotation of the one actuator to both hubs, and accordingly, to both bushings. In these embodiments of the invention, the wheel axle is configured so that rotation of the one actuator is transferred to the axle. This may be done via a variety of techniques such as by keying the hub to the axle or by using an axle having a hexagonal or similarly shaped cross-section.

Rotation of the wheel axle is transferred to rotation of the other hub and bushing in any of several ways. For example, in some embodiments of the invention, the actuatorless hub, and/or its corresponding bushing, includes a male key member which interfits with a groove in the wheel axle. In other embodiments of the invention, the through holes in the actuatorless hub and its corresponding bushing are non-circular and the appropriate end of the wheel axle is shaped correspondingly.

These and other objects and features of the invention will be more fully appreciated by reference to the following detailed description which is to be read in conjunction with the attached drawing.

DETAILED DESCRIPTION

The roller axle height adjustment system of the invention utilizes a rotatable bushing having a hole through which a skate roller axle extends. A rotatable bushing is provided at each end section of an axle. In some embodiments of the invention a lever is formed integrally with the roller bushing. In these embodiments, the handle includes a locking mechanism which functions to lock the rotatable bushing in place after it has been rotated to a desired position. The handle also provides a means for rotating the rotatable bushing by hand without the need for removing or loosening the rotatable bushing from position in a skate chassis which also supports the roller axle. The roller axle is positioned through the through hole so that the axle is supported by the rotatable bushing which, in turn, is supported by the chassis. The through hole is positioned off center from the rotational axis of the rotatable bushing. The locking mechanism can be secured in any of a plurality of locking positions which, in turn, allows the through hole to be positioned in one of a plurality of locking positions. Consequently, the through hole may be positioned in one of a plurality of different vertical heights.

In embodiments of the invention wherein both rotatable bushings include actuators, the actuators, and thereby the bushings, are rotated to the same desired position simultaneously in order to position the through holes in each bushing at the same vertical height relative to the skate chassis. This is effected manually by grasping an actuator, such as a lever integrally formed with the rotatable bushing, and rotating the handle. The actuator is then locked in place by locking structure formed with the chassis. This height adjustment system may be used on one or a plurality of roller axles. Typically, it is positioned on one or more intermediate axles in the line of roller axles on the skate. Thus, height adjustment can be effected by hand without the need for special tools and without the need for disassembling or loosening any portion of the skate.

Figure 1:
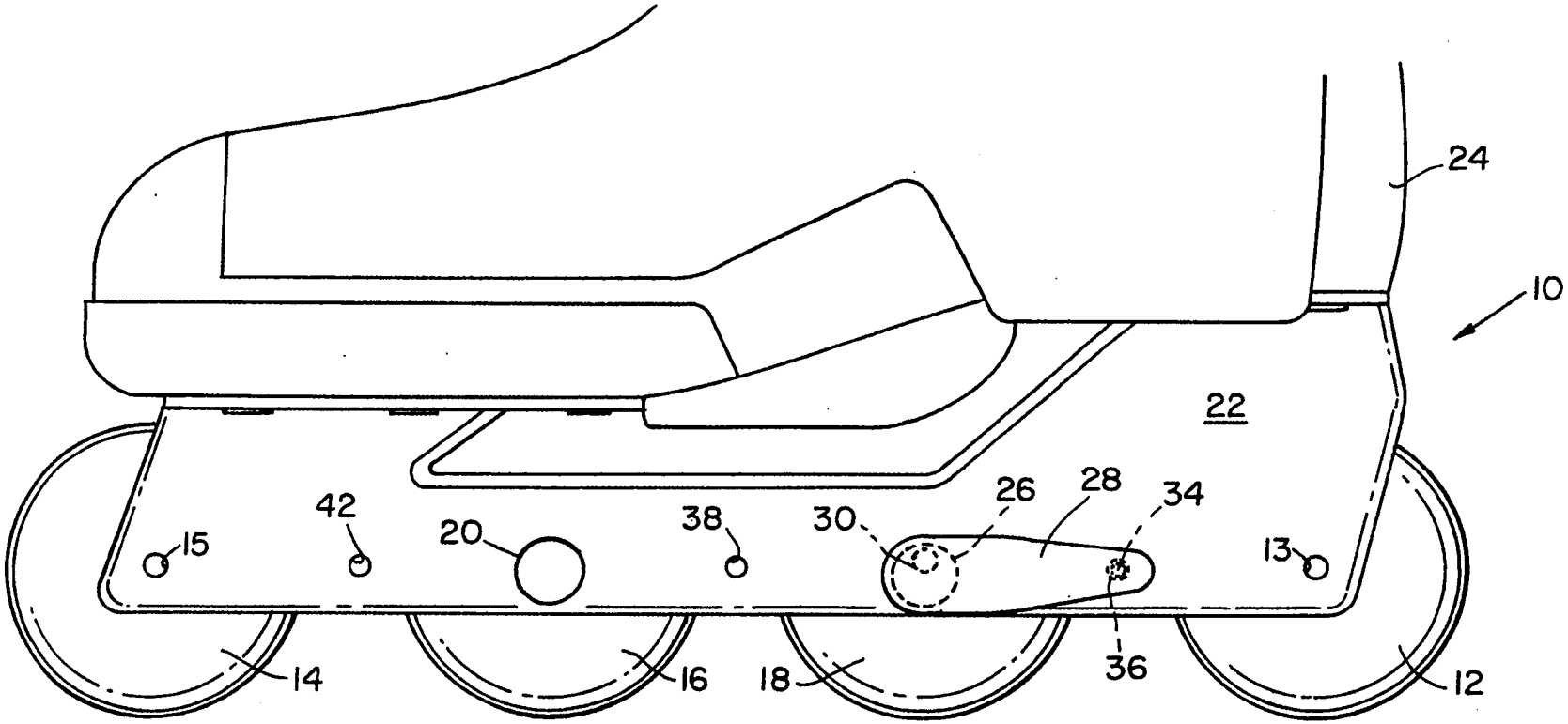
FIG. 1 is a side view of an in line skate utilizing one embodiment of the roller axle height adjustment system of this invention.
Figure 3:
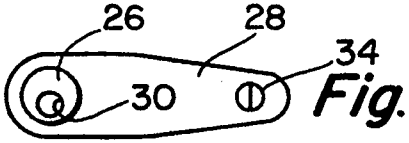
FIG. 3 is a side view of the height adjustment system shown in FIG. 2, FIGS. 4, 4*a*, and 4*b* show the fixed bushing of the prior art.
Figure 2:
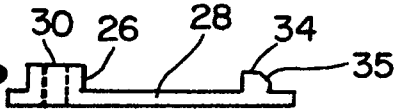
FIG. 2 is a top view of the height adjustment system shown in FIG. 1.

Referring to FIG. 1–3, an in line skate 10 comprises a plurality of rollers including end rollers 12 and 14 and intermediate rollers 16 and 18. Rollers 16 and 18 are provided with one embodiment of the roller axle height adjustment system of the invention. With rollers 16 and 18, a circular hole 20 is provided in fixed bracket 22 which, in turn, is fixed to boot section 24. The hole 20 is of a size which permits the circular rotatable bushing 26 to be snugly fit while permitting its rotation within hole 20. A handle or lever 28 is secured to or formed integrally with bushing 26. The bushing 26 includes a through hole 30 which extends through handle 28 and is of a size which permits an axle for the roller 16 and 18 to be passed therethrough. A male locking member 34 is positioned on the handle 28. The hole 30 is positioned off center from the center of rotation of the bushing 26. The locking member 34 for roller 18 can be positioned in hole 36 or in hole 38 in bracket 22. The holes 20 have centers which are offset downward from the center of holes 13 and 15 which house axles for rollers 12 and 14 so that the rollers 12, 14, 16 and 18 are at the same height at one of the two positions of lever 28. A locking member 34 associated with a second pair of rotatable bushings for roller 16 can be positioned in hole 38 or hole 42. The locking member can include a chamfered surface 35 which permits the locking means to be easily inserted into holes 36, 38 or 42. For convenience, when the handles 28 extend in the same direction, such as when locking members 34 are positioned in holes 36 and 38, rollers 16 and 18 are at the same height as rollers 12 and 14. In at least one second position, the rollers 16 and 18 are at different heights from that of rollers 12 and 14. Locking mechanisms other than extension 34 can be used. For example, an end of the lever 28 could be fit into a bracket formed integrally with bracket 22. All that is needed is that the lever 28 be held in place during use of the skate.

Figure 5:
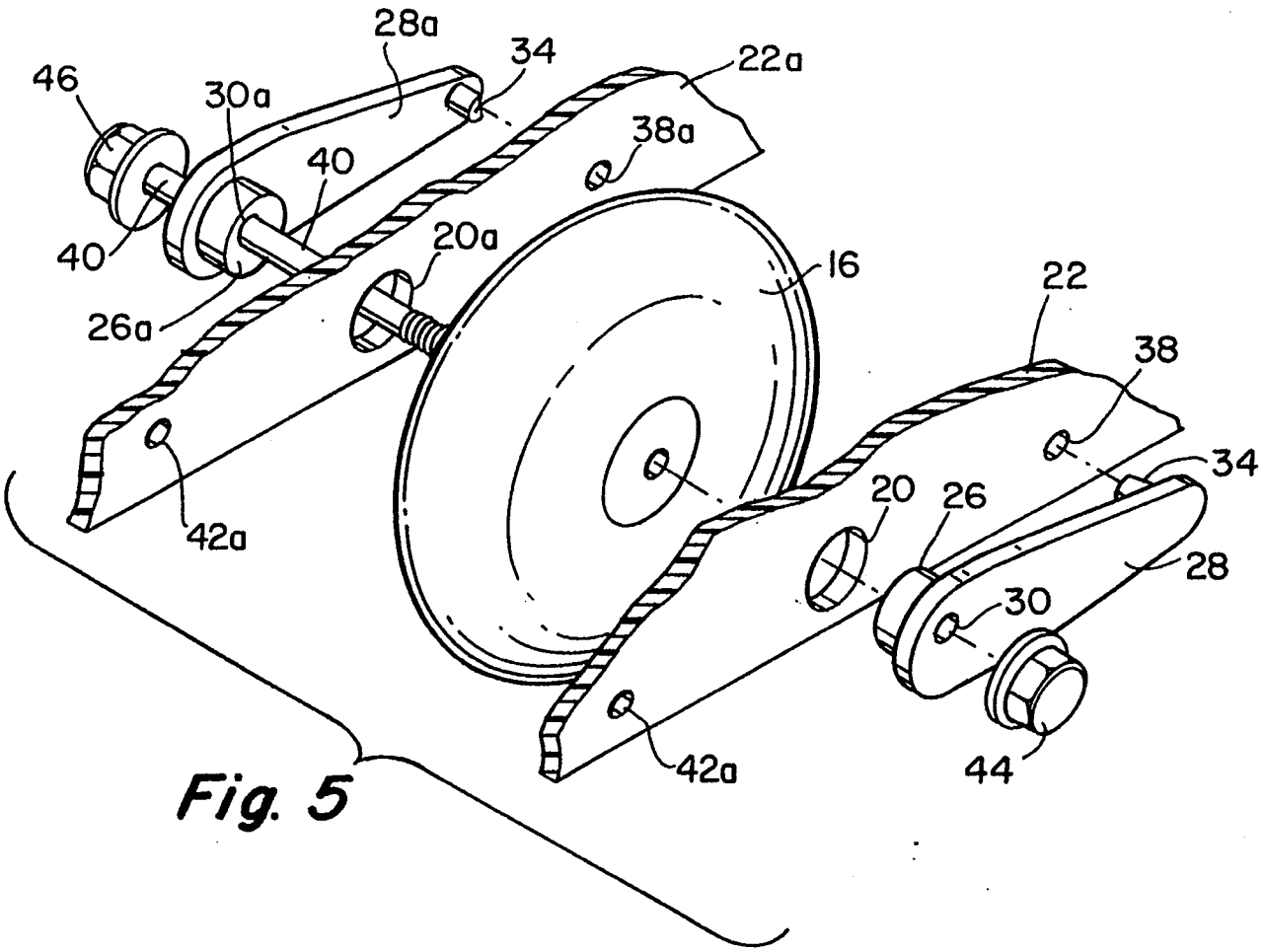
FIG. 5 is an exploded view of one embodiment of the height adjustment system of this invention.

Referring to FIG. 5, one embodiment of the height adjustment system of this invention is shown in position on an in line skate. The rotatable bushings 26 and **26*a* are positioned on axle 40 which passes through holes 30 and 30*a*. The axle 40 also passes through bracket 22 which is positioned on both sides of roller 16. The axle is secured in place by conventional means such as nuts 44 and 46. The levers 28 and 28*a* are positioned and locked in place so that the holes 30 and 30*a* are at the same height. For convenience of the user, this is effected when handles 28 and 28*a* extend in the same direction. The rotatable bushings 26 and 26*a* can be rotated in place within bracket 22 without the need for loosening nuts 44 or 46 and without the need for removing axles 40 from bracket 22**.

Figure 4:
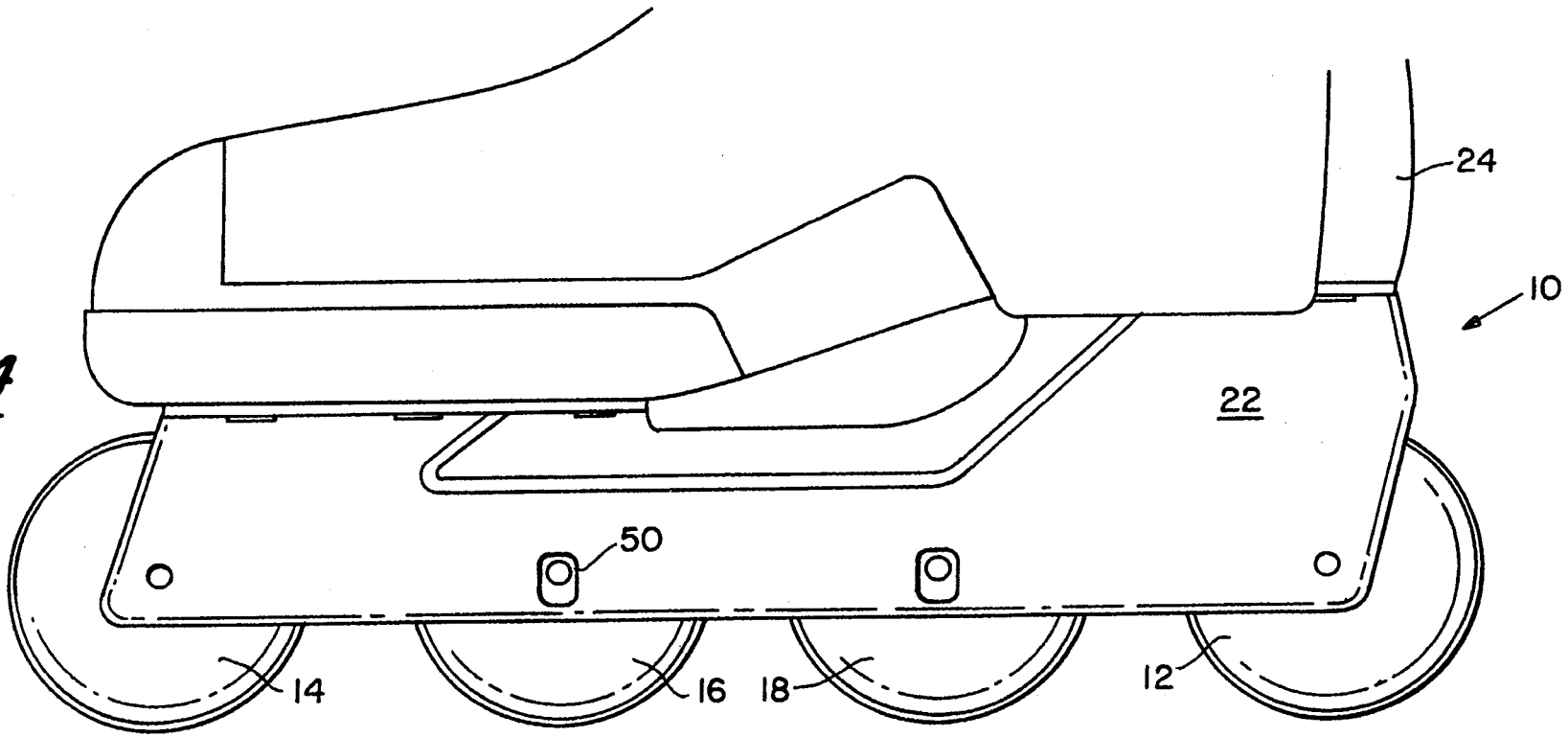
Fig. 4 PRIOR ART
Figure 4B:
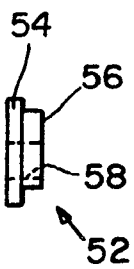
Fig. 4b PRIOR ART
Figure 4A:
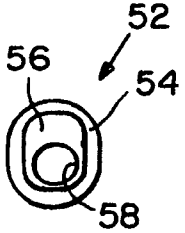
Fig. 4a PRIOR ART
Figure 6:
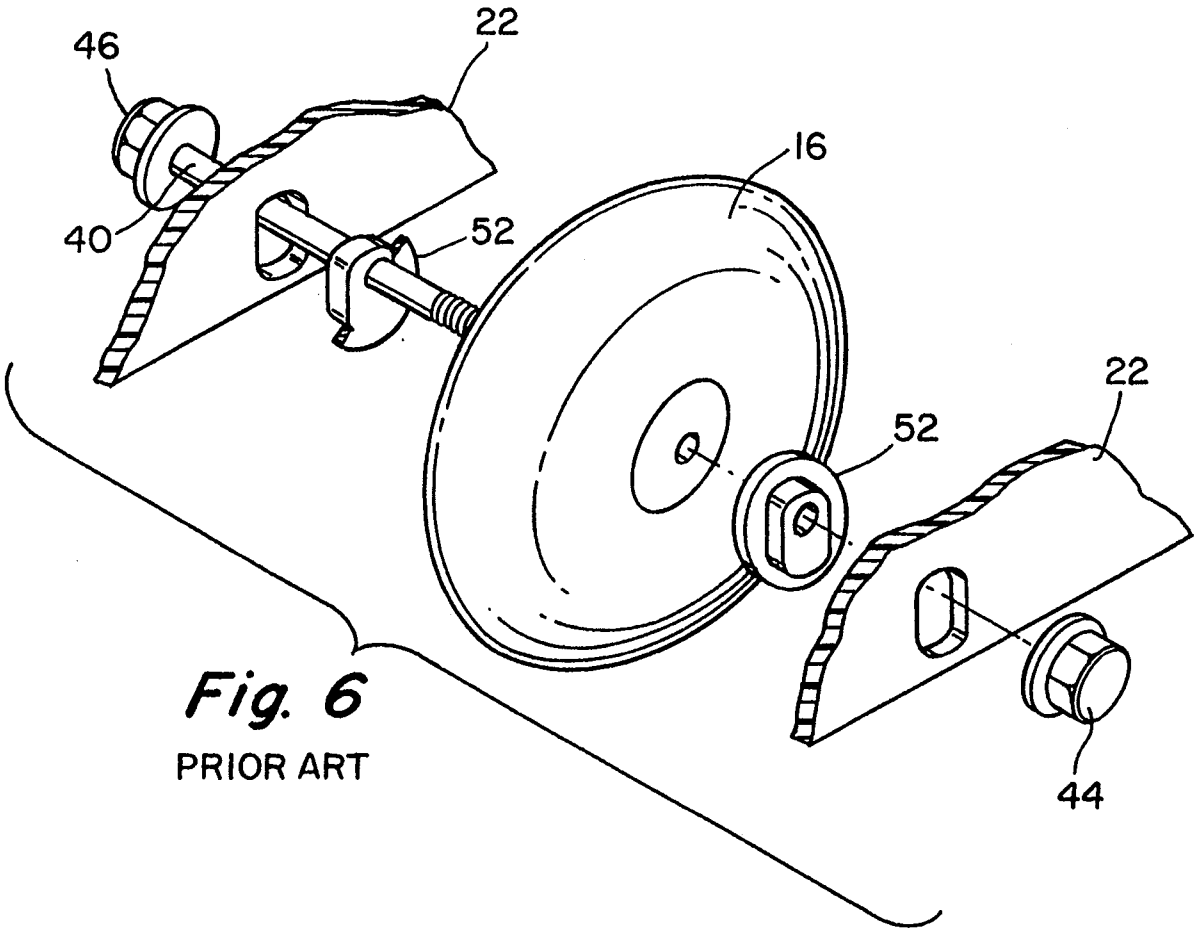
Fig. 6 PRIOR ART

Referring to FIGS. 4 and 6, the roller axle height adjustment means of the prior art is shown. The bracket 22 is provided with a non-circular hole 50 such as elliptical hole as shown. A fixed bushing 52 includes a flange 54 and an elliptical boss 56 which fits in hole 50. Flange 54 serves to fix the bushing 52 in place in bracket 22. A through hole 58 is positioned off center from the center of the elliptical boss 56. Thus, hole 58 can be positioned concentrically or non-concentrically in relation to rollers 12 and 14 directly relative to which of the two possible positions elliptical boss 56 is in. In order to change the position of fixed bushing 52 (See FIG. 6), the nuts 44 and 46 must be removed from axle 40 with a suitable tool so that axle 40 can be removed from bracket 22. The fixed bushings 52 then are removed by hand from the bracket 22, rotated 180° and then reinserted in bracket 22. Roller 16 and axle 40 then are repositioned in bracket 22 and the nuts 44 and 46 are secured to the axle with an appropriate tool. In this case as in FIG. 1, the center of elliptical hole 50 is also offset downwardly with respect to the concentrics of 12 and 14 so that equilateral concentricity is only achievable in one position of 56 or 52. Thus, the prior art arrangement requires that the roller support structure be completely disassembled and reassembled.

Figure 5A:
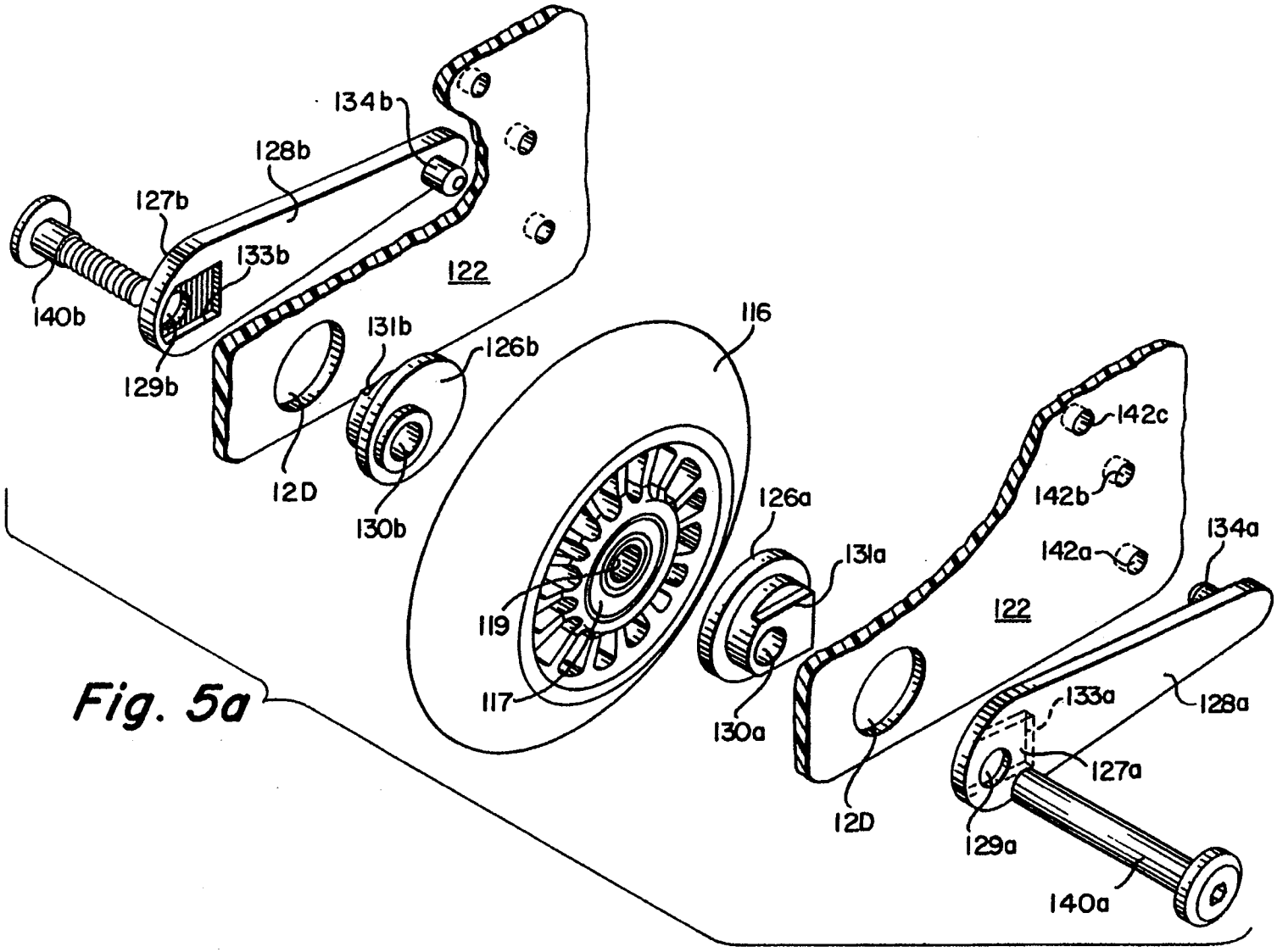
FIG. 5*a* is an exploded view of another embodiment of the height adjustment system of the invention.

Another embodiment of the invention is shown in FIG. 5*a* which depicts a wheel 116 and sections of a skate chassis 122. The chassis 122 defines circular holes 120. A pair of bushings 126*a* and 126*b* is provided which can be rotatably retained in the holes 120. As with the above-discussed embodiments of the invention, the bushings 126*a* and 126*b* define eccentrically located through holes 130*a* and 130*b* for supporting opposite ends of an axle formed of female end 140*a* and male end 140*b*. The bushings 126*a* and 126*b* each include a non-circular ridged portion 131*a* and 131*b* for interfitting with similarly shaped recesses 133*a* and 133*b* in hubs 127*a* and 127*b*. The hubs 127*a* and 127*b* also may be rotatably retained in the circular holes 120. Due to the interfitting nature of the ridged portions 131*a* and 131*b* and recesses 133*a* and 133*b*, rotation of the hubs 127*a* and 127*b* is transferred to rotation of the bushings 126*a* and 126*b*.

In the embodiment of the invention depicted in FIG. 5*a*, the hubs 127*a* and 127*b* are formed integrally with levers 128*a* and 128*b* to facilitate manual rotation of the hubs. Further, the levers 128*a* and 128*b* include extensions 134*a* and 134*b*. The extensions 134*a* and 134*b* interfit in holes 142*a*, 142*b*, and 142*c* formed in the chassis 122 for securing the levers 128*a* and 128*b*, the hubs 127*a* and 127*b*, and hence the bushings 126*a* and 126*b* against unwanted rotation. This system enables a user to adjustably secure the height of the axle 140 relative to the chassis 122. Other locking structures may be employed such as raised ridges in the chassis 122 for grasping portions of the arms 128*a* and 128*b*.

In some embodiments of the invention, the hubs 127*a* and 127*b* and the arms 128*a* and 128*b* are formed as separate elements and coupled together so that rotation of the arms is transferred to rotation of the hubs. This can be achieved in a variety of ways which will be known to those skilled in the art. Additionally, the arms 128*a* and 128*b* may be replaced by other types of actuators such as knobs or dials either formed with or coupled to the hubs 127*a* and 127*b*.

The adjustment system of the invention may be constructed so that both hubs can be rotated with only one actuator. For example, this may be achieved by using a square, hexagonal, or similarly shaped axle so that the axle rotates with rotation of the bushings. For ease of assembly, these embodiments of the invention typically utilize a single piece axle having one circular end which is threaded to receive a securing nut. The wheel 116 is provided with an appropriate bearing 117 so that the wheel 116 may rotate properly regardless of the shape of the wheel through hole 119. Accordingly, the through hole 119 can be configured to pass an axle having any shaped cross-section.

Figure 5B:
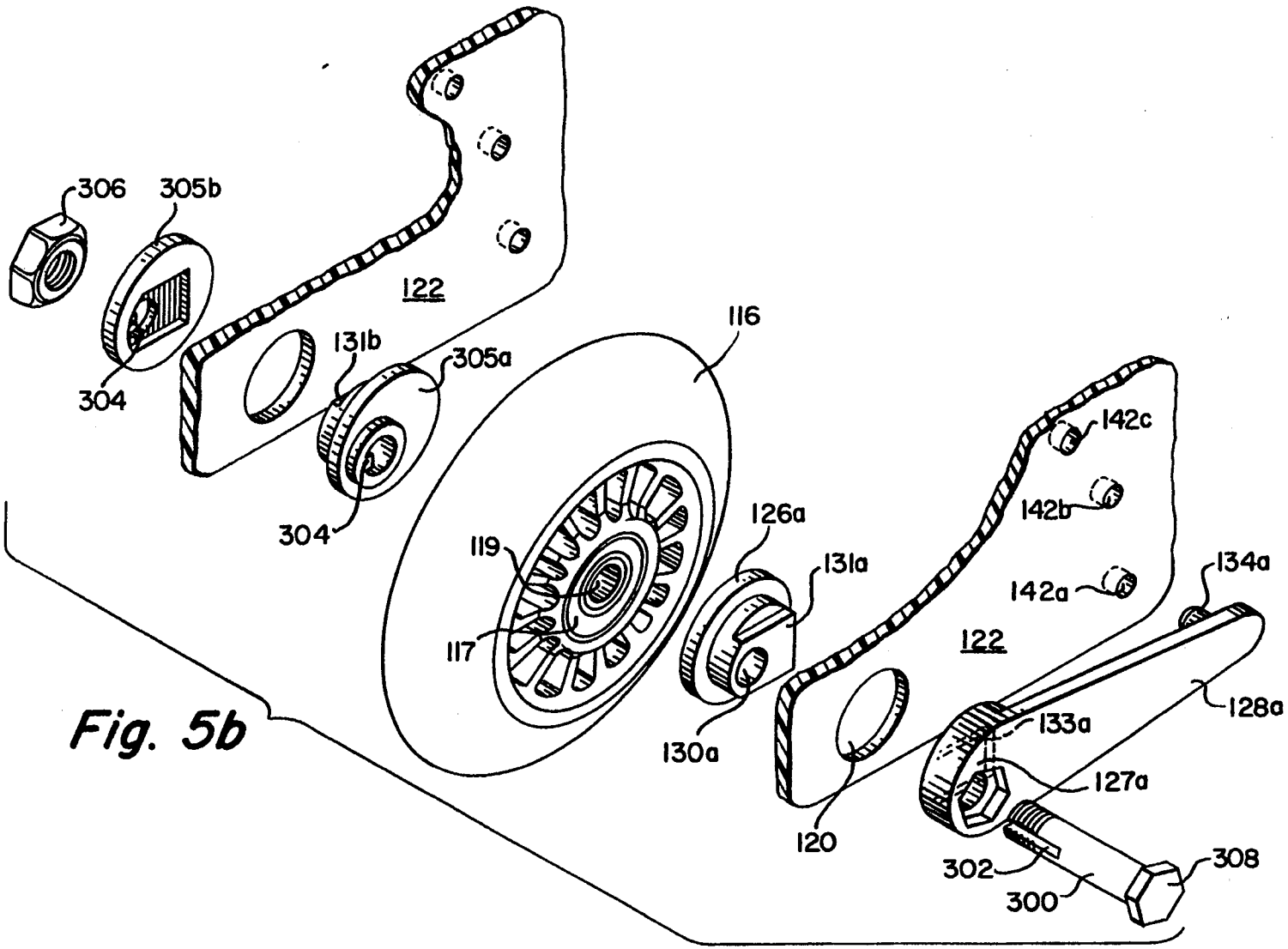
FIG. 5*b* is an exploded perspective view of another embodiment of a height adjustment system according to the invention.
Figure 5E:
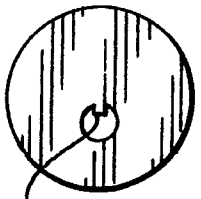
FIG. 5*e* is an end view of a hub taken along line 5*e*—5*e* of FIG. 5*c*and FIG. 6 is an exploded view of a height adjustment system of the prior art.
Figure 5C:
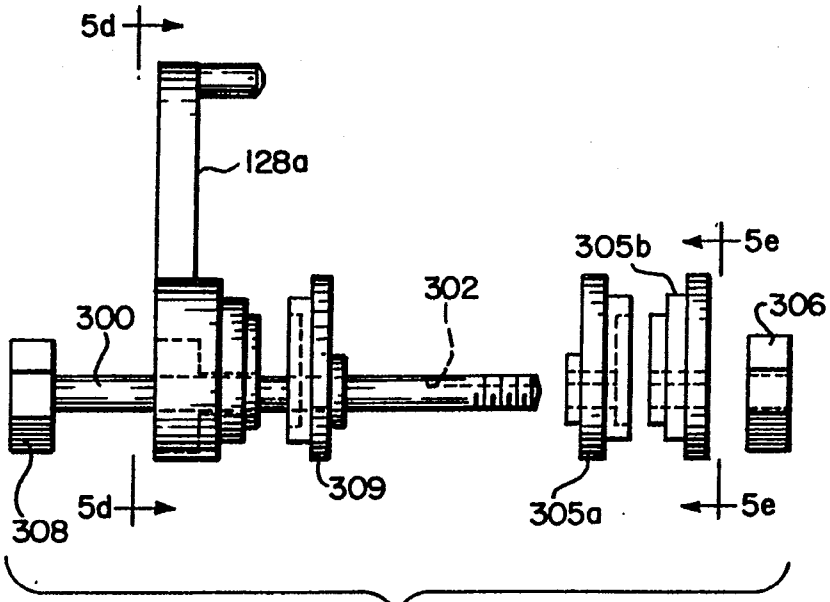
FIG. 5*c* is an exploded side view of some components shown in FIG. 5*b*.
Figure 5D:
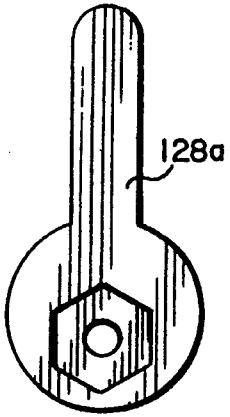
FIG. 5*d* is an end view of a lever taken along line 5*d*—5*d* of FIG. 5*c*.

As shown in FIG. 5*b*, this one-actuator action may also be achieved through the use of a slotted axle 300 and keyed bushings and hubs. The axle 300 is threaded at the end where a keyway or slot 302 is formed. The keyway 302 interfits with keys 304 on one of the bushings, that bushing being two interfitting halves 305*a* and 305*b*. A nut 306 screws onto the threaded end of the axle 300. The axle 300 has a hexagonal head 308 which recesses into the single lever 128*a* such that rotation of the lever 128*a* causes rotation of the axle 300 and thus rotation of bushing 126*a* and bushing 305. Because of the need to recess the head 308, the lever 128*a* should be relatively thick as shown in FIG. 5*c*. Referring to FIGS. 5*c*, 5*d*, and 5*e*, bushing 126*a* can be formed from two halves 128*a* and 309. FIG. 5*e* shows the key more clearly.

While several embodiments of the invention have been set forth above in particular detail, various alterations will be readily apparent to those skilled in the art and are therefore intended to be embraced within the spirit and scope of the invention. Accordingly, the invention is to be defined not by the preceding description but by the claims which follow.

What is claimed is:

1. In combination with an in line skate having a boot, a chassis supporting the boot, and a plurality of wheels rotatably mounted on axles supported by the chassis, the improvement of a system for adjusting the height of at least one of the axles in relation to the chassis, the system comprising a pair of opposed, coaxially rotatable bushings supported by the chassis and each defining a through hole for passing a wheel axle, the axle-receiving through holes being located eccentrically to the rotational axis of the bushings, a pair of hubs, each of the hubs interfitted with a different one of the rotatable bushings so that rotation of the hubs is transferred to equivalent rotation of the bushings, each of the hubs defining a through hole corresponding to the through hole defined by the bushing interfitted with the hub, the through holes defined by the hubs for passing the wheel axle and being located eccentrically to the rotational axis of the hubs and the interfitted bushings, securing means coupled to the wheel axle for securing the bushings, hubs, and axle relative to the chassis, an actuator coupled to a first one of the hubs for receiving a force to rotate the first one of the hubs and the bushing interfitted therewith, means for transferring rotation of the first one of the hubs and the bushing interfitted therewith (i) to rotation of the axle and (ii) to rotation of the other hub and the other bushing interfitted therewith, and locking means, formed with the chassis, for releasably and replaceably cooperating with a portion of the actuator to secure the hubs and the bushings interfitted therewith against unwanted rotation.

2. The combination as set forth in claim 1 wherein the system further comprises multiple pairs of opposed, rotatable bushings and interfitted hubs for adjusting the height of multiple axles in relation to the chassis.

3. The combination as set forth in claim 1 wherein the locking means is capable of receiving the portion of the actuator in any of several locations.

4. The combination as set forth in claim 3 wherein the locking means comprises a plurality of apertures located in the chassis for lockingly receiving the portion of the actuator.

5. In combination with an in line skate having a boot, a chassis supporting the boot, and a plurality of wheels rotatably mounted on axles supported by the chassis, the improvement of a system for adjusting the height of at least one of the axles in relation to the chassis, the system comprising a pair of opposed, coaxially rotatable bushings supported by the chassis and each defining a through hole for passing a wheel axle, the axle-receiving through holes being located eccentrically to the rotational axis of the bushings, securing means coupled to the wheel axle for securing the bushings and axle relative to the chassis, an actuator coupled to a first one of the rotatable bushings for receiving a force to rotate the first one of the bushings, means for transferring rotation of the first one of the bushings (i) to rotation of the axle and (ii) to rotation of the other bushing, and locking means, formed with the chassis, for releasably and replaceably securing the actuator, and hence the bushings, against unwanted rotation.

6. The combination as set forth in claim 5 wherein the system further comprises multiple pairs of opposed, rotatable bushings for adjusting the height of multiple axles in relation to the chassis.

7. The combination as set forth in claim 5 wherein the locking means is capable of receiving the portion of the actuator in any of several locations.

8. The combination as set forth in claim 7 wherein the locking means comprises a plurality of apertures located in the chassis for lockingly receiving the portion of the actuator.

* * * * *